US006875437B2

(12) United States Patent
Yanovsky et al.

(10) Patent No.: US 6,875,437 B2
(45) Date of Patent: Apr. 5, 2005

(54) HAIR PROTECTION BAG WITH A FASTENING OPENING AND A METHOD FOR USING THE SAME

(76) Inventors: Mary Yanovsky, 250 W. Parliament Pl., Apt. 302, Mt. Prospect, IL (US) 60056; Steve Yanovsky, 1221 Kensington St., Mundelein, IL (US) 60060

( * ) Notice: Subject to any disclaimer, the term of this patent is extended or adjusted under 35 U.S.C. 154(b) by 280 days.

(21) Appl. No.: 10/001,414

(22) Filed: Oct. 31, 2001

(65) Prior Publication Data

US 2003/0079756 A1 May 1, 2003

(51) Int. Cl.[7] ..... A42B 1/12; A42B 1/22; A45D 8/40

(52) U.S. Cl. ..... 424/401; 2/410; 2/417; 2/171; 2/171.1; 2/171.2; 2/171.4; 2/171.5; 2/171.6; 2/173.5; 2/181; D02/875; D02/877; D02/865; D02/867

(58) Field of Search ..... 2/410, 417, 171, 2/171.2–171.6, 173.5, 181; D02/867, 875, 877, 865; 424/401

(56) References Cited

U.S. PATENT DOCUMENTS 3,929,143 A * 12/1975 Coleman ..... 132/243
4,864,698 A * 9/1989 Brame ..... 128/DIG. 15
5,099,865 A 3/1992 Flannery et al. ..... 2/174
5,685,018 A 11/1997 West ..... 2/174
5,950,636 A * 9/1999 Hickey ..... 132/200
6,199,213 B1 * 3/2001 Whang ..... 2/181

* cited by examiner

*Primary Examiner*—Edward J. Webman
(74) *Attorney, Agent, or Firm*—Patents+TMS, P.C.

(57) ABSTRACT

A hair protection bag with a first opening and a method for using the same are provided. The hair protection bag may have an open perimeter, a band around the open perimeter and a first opening associated with the bag. The band may be detachably connected to the open perimeter using an adhesive. The first opening may have a fastening system associated therewith to fasten, un-fasten and/or re-fasten the bag. The hair protection bag may further have a second opening associated with the bag. The second opening may have a fastening system associated therewith to fasten, un-fasten and/or re-fasten the bag. A cotton band may be attached to the open perimeter of the bag to prevent treatment solution from leaking from the bag. The first opening associated with the bag may be, for example, a zipper or hook and loop fasteners. The second opening associated with the bag may be, for example, a zipper or hook and loop fasteners.

17 Claims, 6 Drawing Sheets

HAIR PROTECTION BAG WITH A FASTENING OPENING AND A METHOD FOR USING THE SAME

BACKGROUND OF THE INVENTION

The present invention generally relates to a hair protection bag with a fastening opening and a method for using the same. More specifically, the present invention provides a hair protection bag that protects the skin from chemicals used to treat human hair, such as, for example, permanent wave solution.

It is, of course, generally known in the beauty industry by professional salons and beauty store operators to provide plastic bags to protect facial areas, such as the skin and eyes, for example, of individuals receiving hair treatments with chemicals. It is also generally known to provide plastic bags for individuals receiving hair treatments to keep the treated hair at a specific temperature. However, often the plastic bags allow the chemicals to escape onto, for example, the skin of the individuals, which causes discomfort. The chemicals may contain an unpleasant odor and may stain as well as sting the skin of the individuals. Further, allowing air into the covered treated hair area may alter the temperature of the treated hair, thereby, affecting the desired outcome of the treatments. Further, the plastic bags may not be sufficiently re-fastened if, for example, a professional stylist chooses to check and subsequently add additional chemicals to the hair by removing a portion of the bag and then re-applying the bag.

A need, therefore, exists for a hair protection bag with a fastening opening and a method for using the same that keeps chemicals from leaking onto the facial skin of individuals receiving hair treatments, protects the individuals from the odors of the treatments, maintains the temperature inside the bag, and allows users to fasten, un-fasten and re-fasten the bag.

SUMMARY OF THE INVENTION

The present invention generally relates to a hair protection bag with a fastening opening and a method for using the same. More specifically, the present invention provides a hair protection bag that may provide protection to skin from chemicals used to treat human hair, such as, for example, permanent wave solution.

To this end, in an embodiment of the present invention, a hair protection device is provided. The device has a bag having an open perimeter. The device further has a band connected to the open perimeter of the bag with a first opening opposite the open perimeter.

In another embodiment, the device has a second opening adjacent the first opening.

In another embodiment, the device has a band detachably connected to the open perimeter of the bag.

In another embodiment, the band is cotton.

In another embodiment, the band is rubber.

In another embodiment, the device has a first fastener associated with the first opening.

In another embodiment, the device has a second fastener associated with the second opening.

In another embodiment, the first fastener associated with the bag is a zipper.

In another embodiment, the first fastener associated with the bag is a hook and loop fastener.

In another embodiment, the second fastener associated with the bag is a zipper.

In another embodiment, the second fastener associated with the bag is a hook and loop fastener.

In another embodiment, a method is provided for using a hair protection device on a treated area of an individual. The method comprises the steps of: providing a bag having an open perimeter; providing a band around the open perimeter of the bag; providing a first opening associated with the bag and enclosing the first opening around the treated area.

In another embodiment, the method provides a second opening associated with the bag and enclosing the second opening around the treated area.

In another embodiment, the method provides for detachably connecting the band to the open perimeter of the bag.

In another embodiment, the method provides a first fastener to enclose the first opening around the treated area.

In another embodiment, the method provides a second fastener to enclose the second opening around the treated area.

In another embodiment, the method provides that the first fastener is a zipper.

In another embodiment, the method provides that the second fastener is a zipper.

It is, therefore, an advantage of the present invention to provide a hair protection bag and a method for using the same that may be selectively opened and closed.

Another advantage of the present invention is to provide a hair protection bag and a method for using the same that protects the skin from chemicals used to treat human hair.

Yet another advantage of the present invention is to provide a hair protection bag and a method for using the same that has a fastening opening on the hair protection bag.

A still further advantage of the present invention is to provide a hair protection bag and a method for using the same that may be fastened, un-fastened and re-fastened.

Another advantage of the present invention is to provide a hair protection bag and a method for using the same wherein the temperature of the treated hair protected by the bag may be maintained.

Yet still another advantage of the present invention is to provide a hair protection bag and a method for using the same that has a detachable band.

A still further advantage of the present invention is to provide a hair protection bag and a method for using the same that uses an adhesive to attach, detach and re-attach a band.

Another advantage of the present invention is to provide a hair protection bag and a method for using the same that has a fastening system, such as, for example, a zipper or a hook-and-loop fastener.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a hair protection bag with a fastening opening and a method for using the same. More specifically, the present invention provides a hair protection bag that may provide protection to skin from chemicals used to treat human hair, such as, for example, permanent wave solution.

Figure 1:
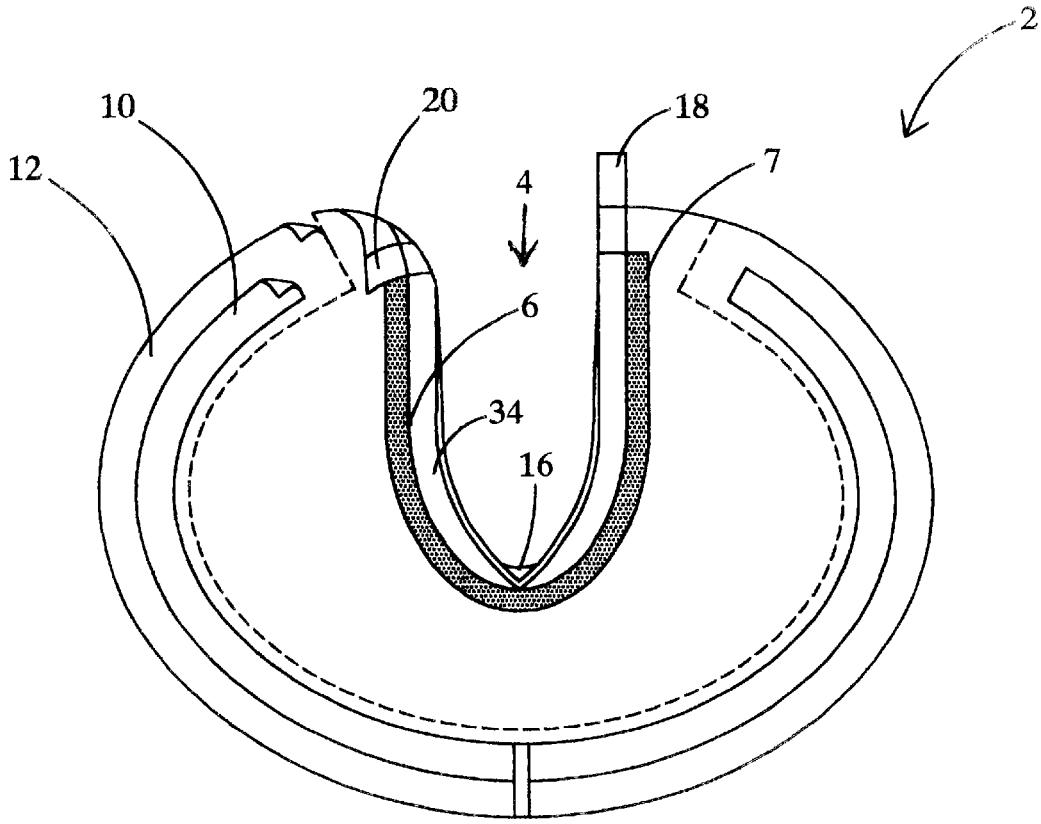
FIG. 1 illustrates a perspective view of a hair protection bag with a fastening opening in an embodiment of the present invention.
Figure 2:
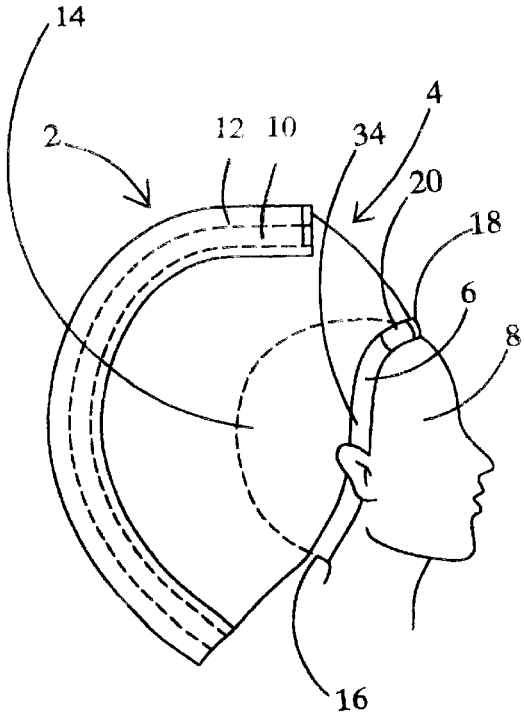
FIG. 2 illustrates a side view of a consumer wearing a hair protection bag with a fastening opening in an embodiment of the present invention.
Figure 3:
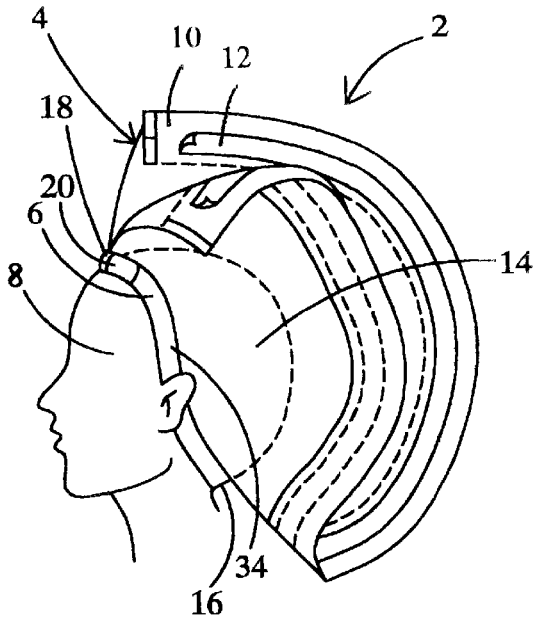
FIG. 3 illustrates a side view of a consumer wearing a hair protection bag with a fastening opening in an embodiment of the present invention.

Referring now to the drawings wherein like numerals refer to like parts, FIG. 1 illustrates a hair protection bag 2 having an open perimeter 4. The open perimeter 4 may have a band 6 that may fasten the hair protection bag 2 to a consumer 8 as shown in FIG. 2. The band 6 may be detachably connected to the open perimeter 4. The hair protection bag 2 may have a first edge 10 that may be fastened and re-fastened around the treated area 14 of the consumer 8. A central point 16 may be placed on the neck of the consumer 8, then the band 6 may fasten the hair protection bag 2 over a treated area 14 of the consumer 8. The hair protection bag 2 may have a second edge 12 that May be fastened, un-fastened and re-fastened over the first edge 10. A tab 18 may attach to a tab receiver 20 to hold the hair protection bag 2 to the consumer 8 as shown in FIGS. 2 and 3.

An individual, such as, for example, a hair care specialist, may fasten the hair protection bag 2 to a consumer 8 or, alternatively, the consumer 8 may fasten the hair protection bag 2 to his/her own treated area 14. The treated area 14 typically consists of, for example, an area of hair of the consumer 8.

To use the bag 2, either an individual or the consumer 8 may place the central point 16 on the back of the neck of the consumer 8 and may place the band 6 along an area that sufficiently covers the treated area 14. The band 6 may be detachable so that the individual or the consumer 8 may attach the band 6 onto the open perimeter 4 of the bag 2. The band 6 may be attached to the hair protection bag 2 using an adhesive means 7. The band 6 may be attached before placing the hair protection bag 2 around an area that sufficiently covers the treated area 14. The individual or the consumer 8 may attach the tab 18 to the tab receiver 20 which may hold the hair protection bag 2 in place during hair treatment.

After hair treatment occurs on the treated area 14, the individual or the consumer 8 may fasten the hair protection bag 2 by wrapping the first edge 10 around the treated area and fastening the first edge 10 together. The individual or the consumer 8 may fasten the first edge 10 and the second edge 12 together using, for example, a zipper, hook and loop fasteners, or other like fasteners or openings. The individual or the consumer may further fasten the hair protection bag 2 to the consumer 8 by fastening the second edge 12, located adjacent the first edge 10, together using, for example, a zipper, hook and loop fasteners, or other like fasteners or openings. The individual or consumer 8 may check on the status of the hair treatment by unfastening the second edge 12 and unfastening the first edge 10. The consumer 8 may re-fasten the first edge 10 and the second edge 12 after unfastening the second edge 12 and unfastening the first edge 10.

FIG. 2 illustrates the hair protection bag 2 fastened to the consumer 8 using the band 6, the first edge 10 and the second edge 12. In FIG. 2, the first edge 10 is fastened. The second edge 12 may also be fastened to cover the first edge 10. The hair protection bag 2 may fasten around the treated area 14 by wrapping the first edge 10 around the treated area and fastening the first edge 10 together using, for example, a zipper, hook and loop fasteners, or other like fasteners or openings. The hair protection bag 2 may further fasten around the treated area 14 by fastening the second edge 12, located adjacent the first edge 10, together using, for example, a zipper, hook and loop fasteners, or other like fasteners or openings. The band 6 may attach the hair protection bag 2 around the treated area 14 of the consumer 8. The band 6 may prevent hair treatment chemicals inside the hair protection bag 2 from leaking. To this end, the band 6 may include cotton or rubber to absorb and/or to prevent leakage of hair treatment chemicals.

FIG. 3 illustrates the hair protection bag 2 fastened to the consumer 8 around the band 6 but not fastened to the consumer 8 around the first edge 10 or the second edge 12. The band 6 may be fastened to the consumer 8 before various hair treatments are applied. In this way, the hair protection bag 2 may protect the area below the band 6 from such hair treatments while the treatments are applied. After the hair treatments are applied, the first edge 10 and the second edge 12 may be fastened.

Figure 4:
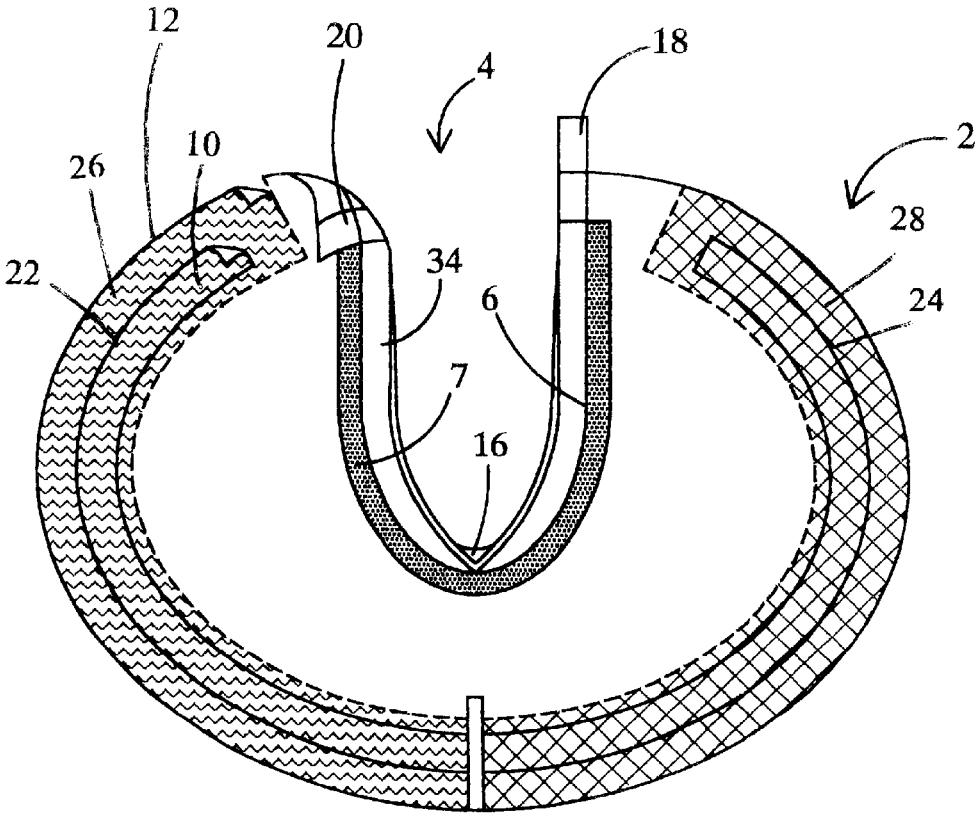
FIG. 4 illustrates a perspective view of a hair protection bag with a fastening opening in an embodiment of the present invention.

FIG. 4 illustrates a front view of the hair protection bag 2. The first edge 10 may prevent hair treatments from leaking from the hair protection bag 2 using inner hook fasteners 22 and inner loop fasteners 24. The inner hook fasteners 22 and the inner loop fasteners 24 may allow an individual or the consumer 8 as shown in FIG. 3, using the hair protection bag 2 to fasten, un-fasten and/or re-fasten the first edge 10 of the hair protection bag 2. The second edge 12 may prevent hair treatments from leaking from the hair protection bag 2 using outer hook fasteners 26 and outer loop fasteners 28. The outer hook fasteners 26 and the outer loop fasteners 28 may allow an individual or the consumer 8 using the hair protection bag 2 to fasten, un-fasten and/or re-fasten the second edge 12 of the hair protection bag 2.

Figure 5:
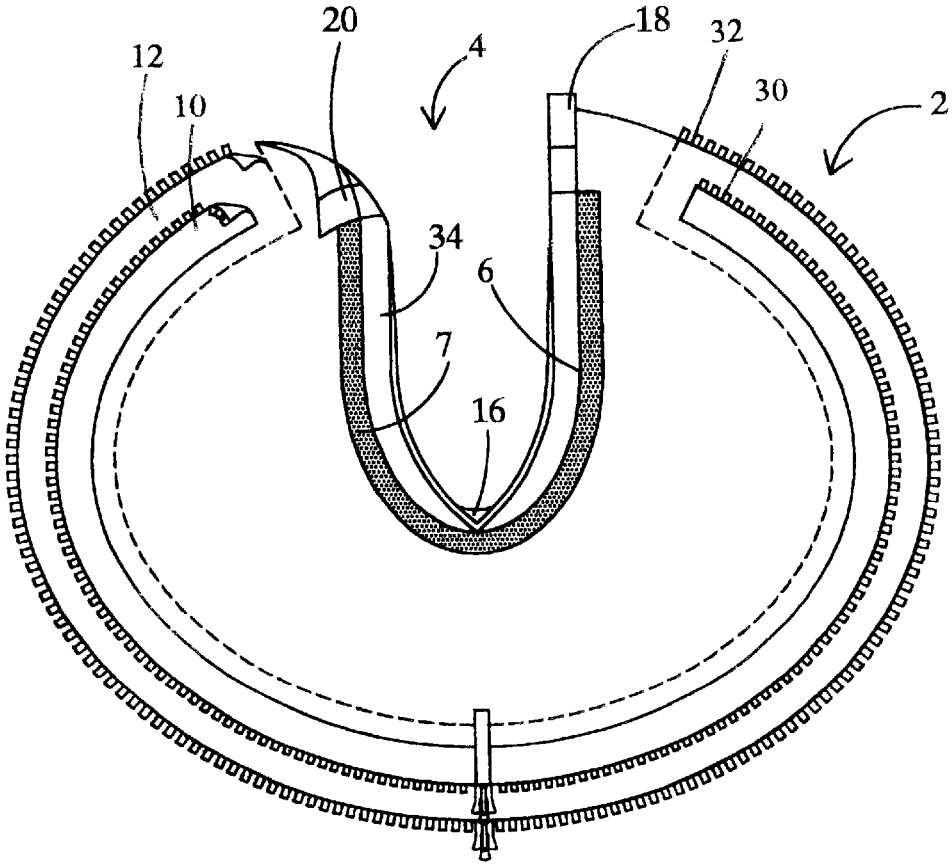
FIG. 5 illustrates a perspective view of a hair protection bag with a fastening opening in an embodiment of the present invention.

FIG. 5 illustrates a front view of the hair protection bag 2. The first edge 10 may prevent hair treatments from leaking from the hair protection bag 2 using an inner zipper 30. The inner zipper 30 may allow an individual or the consumer 8 as shown in FIG. 3, using the hair protection bag 2 to fasten, un-fasten and/or re-fasten the first edge 10 of the hair protection bag 2. The second edge 12 may prevent hair treatments from leaking from the hair protection bag 2 using an outer zipper 32. The outer zipper 32 may allow an individual or the consumer 8 using the hair protection bag 2 to fasten, un-fasten and/or re-fasten the second edge 12 of the hair protection bag 2.

Figure 6:
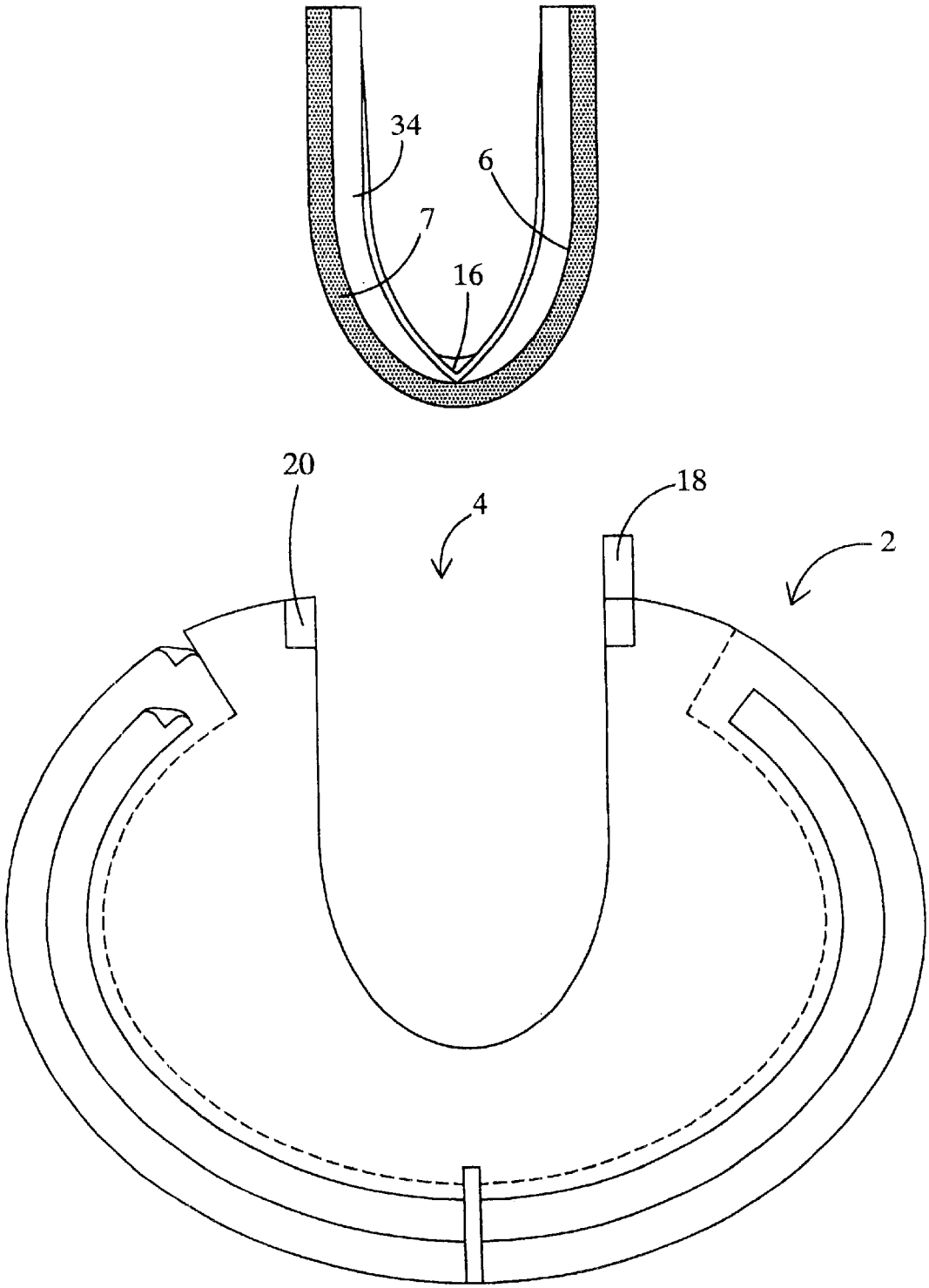
FIG. 6 illustrates an exploded view of a hair protection bag with a fastening opening in an embodiment of the present invention.

FIG. 6 illustrates a front view of the hair protection bag 2 with the band 6 that may be detached. The band 6 may be attached to the open perimeter 4 using, for example, the adhesive 7. The band 6 may be attached by an individual or consumer 8 using the hair protection bag 2 as shown in FIGS. 2 and 3. The band 6 may have a clotting material 34 opposite the adhesive 7 that may prevent hair treatments from leaking from the hair protection bag 2. The clotting material 34 may be, for example, cotton or rubber.

Figure 7:
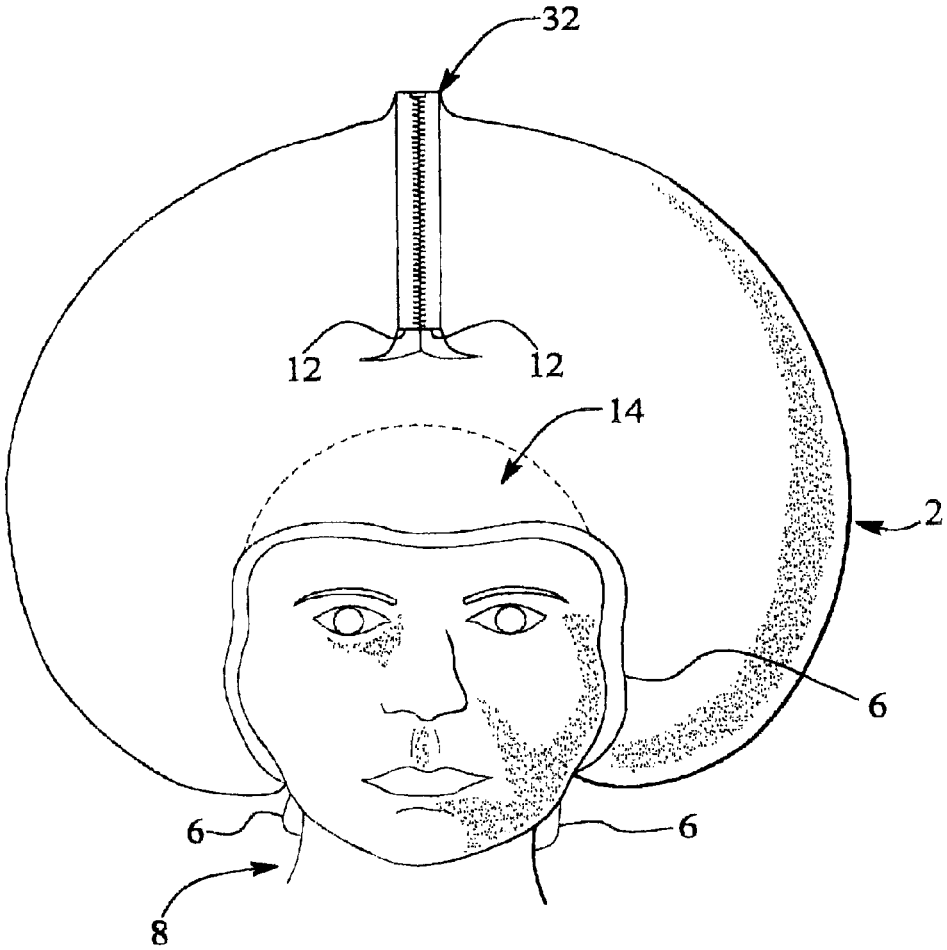
FIG. 7 illustrates a front view of an individual wearing a hair protection bag in an embodiment of the present invention.

FIG. 7 illustrates a front view of the consumer 8 wearing the hair protection bag 2. The band 6 may contact the consumer 8 and the second edge 12 may be fastened together by a zipper 32. As result, the hair protection bag 2 may cover the treated area 14 of the consumer 8.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A hair protection device to secure around hair on a head of an individual, the device comprising:

a bag having an open perimeter wherein the open perimeter envelops the head of the individual;

a band connected to the open perimeter of the bag;

a fastener removably securing the band to the open perimeter of the bag;

a tab connected to the band; and a tab receiver connected to the band wherein the tab attaches to the tab receiver to secure the bag to the head of the individual.

2. The device of claim 1 further comprising:

a second opening adjacent the first opening.

3. The device of claim 1 wherein the fastener is an adhesive.

4. The device of claim 1 wherein the band is cotton.

5. The device of claim 1 wherein the band is rubber.

6. The device of claim 1 further comprising:

a first fastener associated with the first opening.

7. The device of claim 2 further comprising:

a second fastener associated with the second opening.

8. The device of claim 6 wherein the first fastener associated with the bag is a zipper.

9. The device of claim 6 wherein the first fastener associated with the bag is a hook and loop fastener.

10. The device of claim 7 wherein the second fastener associated with the bag is a zipper.

11. The device of claim 7 wherein the second fastener associated with the bag is a hook and loop fastener.

12. A hair protection device to secure around hair on a head of an individual, the device comprising:

a bag having an open perimeter wherein the open perimeter envelops the head of the individual;

a band connected to the open perimeter of the bag;

a first opening opposite the open perimeter after the bag is secured to the head of the individual;

a first fastener associated with the first opening wherein the first fastener encloses the hair in the bag; and a second opening surrounding the first opening wherein the second opening is in a position opposite from the open perimeter.

13. The hair protection device of claim 12 further comprising:

a second fastener associated with the second opening.

14. The hair protection device of claim 12 further comprising:

a fastener associated with the second opening wherein the second fastener associated with the bag is a zipper.

15. The hair protection device of claim 12 further comprising:

a fastener associated with the second opening wherein the second fastener associated with the bag is a hook and loop fastener.

16. A hair protection device, the device comprising:

a bag having an open perimeter;

a band connected to the open perimeter of the bag; and a first opening opposite the open perimeter wherein the band is cotton.

17. A hair protection device, the device comprising:

a bag having an open perimeter;

a band connected to the open perimeter of the bag;

a first opening opposite the open perimeter;

a first fastener associated with the first opening wherein the first fastener associated with the bag is a hook and loop fastener.

* * * * *